US007028441B2

(12) United States Patent
Dahl

(10) Patent No.: US 7,028,441 B2
(45) Date of Patent: Apr. 18, 2006

(54) STRUCTURAL MEMBER AND A METHOD OF MANUFACTURING SAID MEMBER

(75) Inventor: Morten Dahl, Kolding (DK)

(73) Assignee: MDT v/Morten Dahl, Kolding (DK)

( * ) Notice: Subject to any disclaimer, the term of this patent is extended or adjusted under 35 U.S.C. 154(b) by 56 days.

(21) Appl. No.: 10/450,560

(22) PCT Filed: Dec. 20, 2001

(86) PCT No.: PCT/DK01/00854

§ 371 (c)(1),
(2), (4) Date: Oct. 28, 2003

(87) PCT Pub. No.: WO02/50385

PCT Pub. Date: Jun. 27, 2002

(65) Prior Publication Data

US 2004/0055226 A1 Mar. 25, 2004

(30) Foreign Application Priority Data

Dec. 21, 2000 (DK) ..... 2000 01918

(51) Int. Cl.
*E04B 9/00* (2006.01)
*E04F 13/04* (2006.01)

(52) U.S. Cl. ..... 52/450; 52/451; 52/730.6; 428/116; 29/897

(58) Field of Classification Search ..... 52/450, 52/451, 737.1, 737.6, 730.6, 86, 107; 428/116, 428/156, 166, 167, 322, 321, 314, 182; 29/897, 29/897.1, 897.2, 897.31, 897.312, 897.32, 29/897.33, 897.35; 206/453
See application file for complete search history.

(56) References Cited

U.S. PATENT DOCUMENTS 997,382 A * 7/1911 Foster ..... 405/125
1,172,710 A * 2/1916 Howe ..... 428/182
1,281,452 A * 10/1918 White ..... 52/450
1,457,303 A 6/1923 Higgins (Continued)

FOREIGN PATENT DOCUMENTS

DE 2061064 12/1970

(Continued)

*Primary Examiner*—Carl D. Friedman
*Assistant Examiner*—Chi Q. Nguyen
(74) *Attorney, Agent, or Firm*—Browdy and Neimark, PLLC

(57) ABSTRACT

The structural member (1) has a generally U-shaped cross-section and comprises a base portion (2) and two leg portions (3) extending at substantially right angles from said base portion. The member comprises at least one thin sheet or foil which is corrugated in a continuous waveform in the longitudinal direction of the member. Each leg portion (3) includes a first section (3*a*) forming an inner wall of the leg portion and a second section (3*b*) parallel with said first section and joining the first section along a first joining line (4) and the base portion along a second joining line (5). The structural member according to the invention is flexible so that it may conform to the surface to which it is to be fastened, but is after fastening to the surface resistant to bending, torsional, tensile and compressive forces and creates a good base for placement of load-carrying composite material, primarily on the base portion. The corrugated structure makes it possible to use a material having a substantially reduced thickness in relation to other elements having corresponding properties with respect to rigidity and strength. The structural member is intended to be connected with a structure to be reinforced or in order to provide eg. heating or ventilation.

20 Claims, 2 Drawing Sheets

U.S. PATENT DOCUMENTS

| | | | | | |
|---|---|---|---|---|---|
| 1,987,798 | A | * | 1/1935 | Siegfried | 428/183 |
| 2,056,349 | A | * | 10/1936 | Evers | 405/16 |
| 2,076,989 | A | * | 4/1937 | Andres et al. | 52/537 |
| 2,215,241 | A | * | 9/1940 | Eichelberger et al. | 428/34 |
| 3,165,815 | A | | 1/1965 | Wögerbauer | |
| 3,247,673 | A | * | 4/1966 | Schneller | 405/284 |
| 3,300,912 | A | * | 1/1967 | Shumaker | 52/39 |
| 3,301,582 | A | | 1/1967 | Linecker | |
| 3,397,497 | A | * | 8/1968 | Shea et al. | 52/334 |
| 3,902,288 | A | * | 9/1975 | Knudson | 52/86 |
| 4,074,495 | A | * | 2/1978 | Bodnar | 52/630 |
| 4,099,359 | A | * | 7/1978 | Sivachenko | 52/630 |
| 4,109,438 | A | * | 8/1978 | De la Concha | 52/630 |
| 4,227,356 | A | * | 10/1980 | Stern et al. | 52/309.4 |
| 4,449,111 | A | | 5/1984 | Nakajima | |
| 4,455,806 | A | | 6/1984 | Rice | |
| 4,526,565 | A | * | 7/1985 | Hummel et al. | 493/196 |
| 4,580,388 | A | | 4/1986 | Maisch | |
| 5,215,806 | A | * | 6/1993 | Bailey | 428/184 |
| 5,958,603 | A | * | 9/1999 | Ragland et al. | 428/595 |
| 6,038,911 | A | * | 3/2000 | Krajewski et al. | 72/379.2 |
| 6,421,969 | B1 | * | 7/2002 | V.o slashed.lstad | 52/220.4 |

FOREIGN PATENT DOCUMENTS

| | | |
|---|---|---|
| DE | 19707133 | 10/1998 |
| EP | 0866196 A1 | 9/1998 |
| GB | 1334887 | 12/1970 |
| WO | WO 90/03921 | 4/1990 |
| WO | WO 98/05836 | 2/1998 |

* cited by examiner

STRUCTURAL MEMBER AND A METHOD OF MANUFACTURING SAID MEMBER

BACKGROUND OF THE INVENTION

1. Technical Field of the Invention

The present invention relates to a structural member having a generally U-shaped cross-section and a longitudinally extending configuration, comprising a base portion and two leg portions extending at substantially right angles from said base portion.

Such structural members are used in a wide field of applications, and their structure and material vary according to the demands made by the particular field.

2. Prior Art

For instance, international published application No. WO 90/03921 discloses a support member for pallets, comprising a channel having a generally U-shaped cross-section. The support member is manufactured from flat sheets of metal, such as steel or aluminum. In order to increase the stiffness of the support member, ribs are pressed into the base and side panels at regular intervals along the length of the support member. The support member disclosed in this document presents good load-bearing properties combined with a relatively low weight.

In other fields of application, it is not only the load-bearing capacity which is important. In order to avoid dimensional stability problems in thin-walled structures such as shell-shaped tools or moulds, or other structures such as boat hulls or aircraft parts, it is well known to provide such structures with reinforcing or stiffening elements. These elements may comprise eg. steel pipes or bars, or profiles having any cross-section, of which rather short parts are welded together in order to adjust the reinforcing or stiffening elements to the shape of structure which may often have a non-planar surface, eg. a surface of double curvature.

From the field of moulding plastic or composite materials, it is known to provide the backside of the tool or mould face with a reinforcing stiffener in the form of a flexible spiral square tube of fibre glass or graphite cloth which is conformed to the shape of the shell to be reinforced and subsequently covered by a mat of glass fibre and subjected to autoclave treatment. However, the flexible tube is relatively expensive and difficult to handle.

It is the object of the invention to provide an alternative to the prior art elements described in the above.

To achieve this, the structural member according to the invention is characterized in that said structural member comprises at least one thin sheet or foil which is corrugated in a continuous waveform in the longitudinal direction of the member; and that each leg portion includes a first section forming an inner wall of the leg portion and a second section parallel with said first section and joining the first section along a first joining line and the base portion along a second joining line.

OBJECT AND SUMMARY OF THE INVENTION

By forming the U-shaped structural member of a corrugated material and by the provision of the double-walled leg portions, the structural member is flexible so that it may conform to the surface to which it is to be fastened, but is after fastening to the surface resistant to ending, torsional tensile and compressive forces and creates a good base for placement of load-carrying composite material, primarily on the base portion. The corrugated structure makes it possible to use a material having a substantially reduced thickness in relation to other elements having corresponding properties with respect to rigidity and strength, thus providing a lightweight product.

In a preferred embodiment, the corrugations of each first section are interlocked with the corrugations of the base portion in the area of said second joining line. The interlocking corrugations between the double-walled leg portions and the base portion provide a security against unintentional release of the sections of the leg portions.

In order to facilitate the manufacture of the member and to improve the retention of the inner leg section, a groove may be formed in the area of said second joining line on the inner side of the structural member.

The corrugations on the outer side of the structural member may be partly cut in the area of the first joining line. Hereby, deformations in the area of the second joining line are prevented or at least diminished.

The structural member may comprise at least one foil or sheet of metal or plastic material or a combination thereof.

Preferably, the structural member comprises at least one foil or sheet of aluminum or an aluminum alloy.

The thickness of the sheet or foil of the structural member may lie in the range of 0.01–0.5 mm.

The first and second sections of the leg portion may be adhesively connected to each other. By the adhesive connection between the leg sections, an improved securing between these sections is achieved.

In another aspect of the invention a method of manufacturing a structural member is provided, comprising the steps of folding a first section of at least one length of a corrugated sheet or foil material corresponding to said first section of the leg portion along said first joining line substantially 180° to abut a second section of said at least one length of material corresponding to said second section of the leg portion, and folding said first and second sections along said second joining line substantially 90°.

BRIEF DESCRIPTION OF THE DRAWINGS

In the following the invention will be described in further detail with reference to the schematic drawings, in which.

DETAILED DESCRIPTION OF THE PREFERRED EMBODIMENTS OF THE INVENTION

Figure 1:
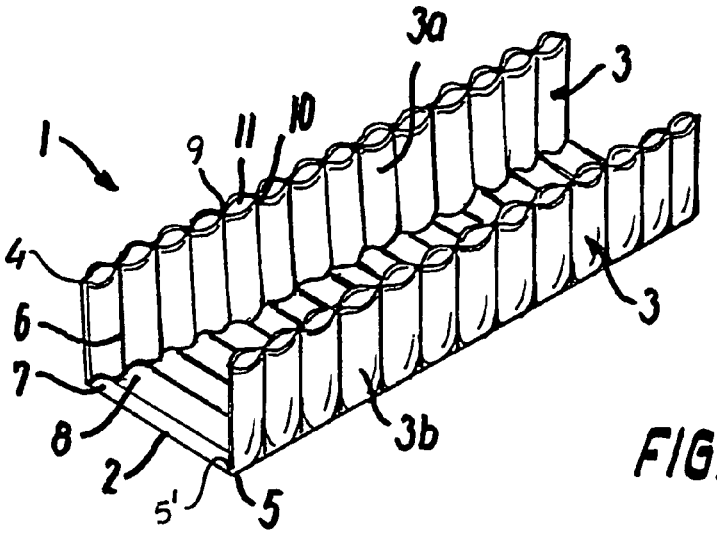
FIG. 1 is a perspective view of a structural member in an embodiment of the invention.

The generally U-shaped structural member 1 as shown in FIG. 1 comprises a base portion 2 and two leg portions 3 extending at substantially right angles from the base portion 2. Each leg portion 3 is double-walled and comprises a first section 3*a* which forms the inner wall and a second section 3*b* which forms the outer wall of the leg portion 3.

The structural member 1 is formed integrally from at least one sheet or foil of any suitable plastic or metal material, or a combination thereof. The thickness of the sheet or foil lies in the range of 0.01 to 0.5 mm, an example being an aluminum foil having a thickness of 0.1 mm. The material of the sheet or foil depends on the intended field of use of the structural member. In applications, in which the thermal properties such as thermal conductivity is desirable a metal sheet or foil material is preferred. Furthermore, two or more foils or sheets, possibly of different materials, may be positioned on top of each other in order to provide a laminate, and a coating of a type known per se may be provided on one or both sides of the sheet(s) or foil(s). The dimensions of the structural member 1 may vary as well, typical examples being a width of approx. 45 mm and a height of approx. 28 mm for a member made from an aluminum foil of a thickness of 0.1 mm. However, the width, height and thickness may be varied according to the application of the structural member, preferably by maintaining the height-width ratio.

Figure 2:
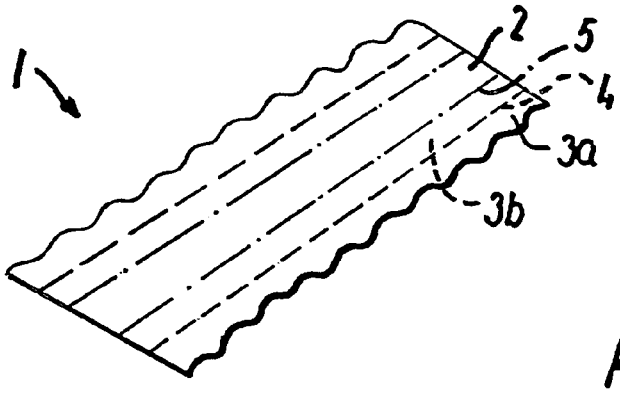
FIG. 2 is a perspective view of the structural member of FIG. 1 but in an unfolded condition.

From the unfolded condition of the structural member 1 shown in FIG. 2, it may be seen that in order to achieve the folded condition of the structural member shown in FIG. 1, the first section 3*a* of each leg portion 3 is folded along a first folding or joining line 4 (dashed line) in a folding operation of substantially 180°. Subsequently, the first and the second sections 3*a*, 3*b* are folded along a second folding or joining line 5 (dash-dot line) in a second folding operation of substantially 90°. In the embodiment shown, it is assured during this second folding operation that the corrugations of the first section 3*a* are positioned in an interlocking relationship with the corrugations of the base portion 2 in the transitional area between each first section 3*a* and the base portion 2, ie. in the area of each second joining line 5, that is, the wave crests 6 of the first section 3*a* are positioned in the wave troughs between successive wave crests 7, 8 of the base portion 2. As an alternative or as a supplemental security against unintentional release between the firs and second sections 3*a*, 3*b* of the leg portion, these sections may be adhesively connected to each other by means of a double-sided self-adhesive tape or any suitable adhesive.

The structural member 1 may furthermore be provided with a groove 5' extending along each second folding line 5 on the upper side of the member as shown in FIG. 2. This groove contributes to an improved locking effect between the leg portions 3 and the base portion 2 and facilitates the second folding operation. During this operation, the outer side of the base portion 2 is flattened so that it may constitute a good base for placement of load-carrying composite material.

During manufacture, the under side of the member as shown in FIG. 2 is furthermore cut along each first folding line 4 such that the wave crests are cut in this area and the first section 3*a* and the second section 3*b* are thus only connected with each other in the portions shown by 9 and 10 in FIG. 1, these portions 9, 10 thus surrounding a gap 11. created by the cut along folding line 4. It is to be noted that the terms defining the orientation of the structural member are used only to define the relative positions of any of the elements. The invention is not limited to any particular orientation of the structural member during use or manufacture.

The structural member 1 may now be connected with a structure to be reinforced or in order to provide eg. heating or ventilation. The structural member 1 may furthermore be connected with other similar elements by separate joining profiles of a suitable material.

Figure 3:
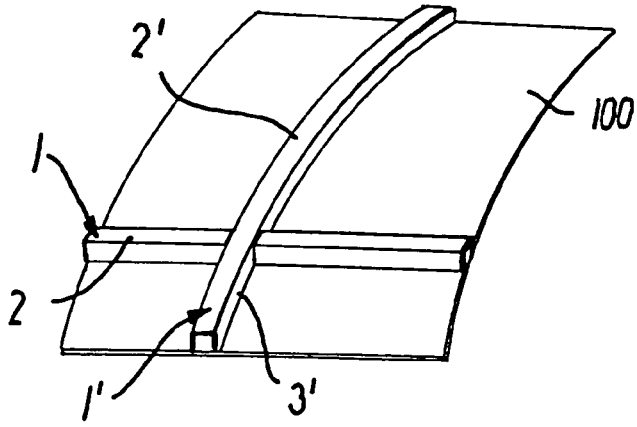
FIG. 3 is a perspective view of two structural members mounted on a surface.

In FIG. 3 an example of a position of use is shown, in which 100 designates a surface of a structure which in the following will be described as a substantially shell-shaped mould defining the surface of a product to be moulded, the surface 100 thus being the back side of the mould. The product may comprise such articles as aircraft parts, boat and ship hulls, windmill rotors etc., but any other products are conceivable. Alternatively, the structural members according to the invention may in the shape of reinforcing struts or stringers form part of the reinforcing structure of such a product, or form part of the mould itself as will be explained in further detail in the following.

Figure 4:
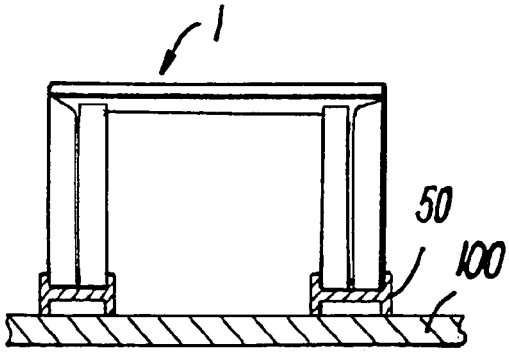
FIG. 4 is an end view on a larger scale of a structural member according to the invention, carrying a separate joining element.

A first structural member 1 is placed on the surface 100 in the desired position and is fastened to the surface 100, either by means of an adhesive material, or by a separate joining profile as indicated in FIG. 4.

The adhesive material preferably comprises the same matrix material, ie. resin and curing agent, as the surface 100. That is, in the case of a mould of glass-fibre reinforced polyester, a polyester is used as adhesive material, and in the case of a mould of glass-fibre or carbon-fibre reinforced epoxy, an epoxy based adhesive is used. It is also conceivable to use the same material in the mould and as the adhesive. In order to improve the attachment of the structural member 1 on the surface 100, a strip of fleece or breather material moistened by eg. polyester or epoxy may be placed on top of the surface at least under the leg portions of the structural member. Hereby, a secure attachment of the structural member 1 to the surface 100 is assured, even if the surface comprises irregularities and, at the same time, an improved retention of the leg portions of the structural member on the surface 100 is assured during the positioning of the structural member on the surface. Subsequently, a second structural member 1' is positioned on the surface 100. In the area of the intersection between the first and second structural members 1 and 1', an area corresponding to width of the structural member 1 is cut away in each leg portion 3' of the second structural member 1' such that the base portion 2' of the second structural member 1' overlaps the base portion 2 of the first structural member 1 in the area of intersection. Preferably, the cut-away area is slightly smaller than the width of the member so that the material in the base portion is stretched to remove the corrugations. Other structural members may now be fastened to the surface 100 in substantially the same manner. Due to the flexibility of the member, the structural members may be positioned along substantially any curvilinear course, and the members may be positioned in eg. a T-shaped or Y-shaped configuration. Subsequent to the fastening of the desired number of structural members according to the invention in any configuration, the structural members and the surface may be covered by eg. a mat of glass fibre.

As shown in FIG. 4, a separate joining profile 50 having a substantially H-shaped cross-section may be mounted on each leg portion of the structural member in order to provide an alternative manner of attachment. The joining profile 50 may be made from a thermoplastic material, such as eg. polypropylene, which is connected with each leg portion 3 of the structural member 1 by heating the thermoplastic material to its melting point and subsequent cooling. The structural member 1 and the joining profile 50 are placed in the desired position and the thermoplastic material of the joining profile is heated locally to its melting point, following which the structural member 1 and the joining profile 50 are pressed against the surface 100. This heating operation may be performed by means of a fan heater or by any other suitable heating means. Alternatively, the entire structural member 1 including the joining profile 50 is heated to above the melting temperature of the thermoplastic material and is subsequently placed and pressed against the surface 100 in a single operation.

Figure 5:
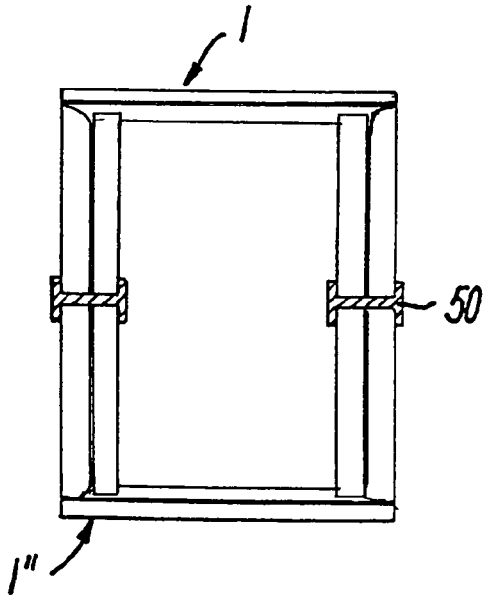
FIG. 5 is a view corresponding to FIG. 4 of two structural members joined by the separate joining element.

The same joining profile 50 may as shown in FIG. 5 be used for joining two structural members 1 and 1", which are connected to each other by using the welding the profile 50 to the opposite leg portions of each of the structural members 1 and 1" in substantially the same manner as described in the above. The element comprising the two structural members 1, 1" and the joining profiles 50 may be manually deformed by bending in the vertical plane in FIG. 5, whereas the element is relatively rigid in a direction perpendicular to that plane. Due to its self-supporting properties, this element may now form part of the framework for lay-up of composite materials.

Figure 6:
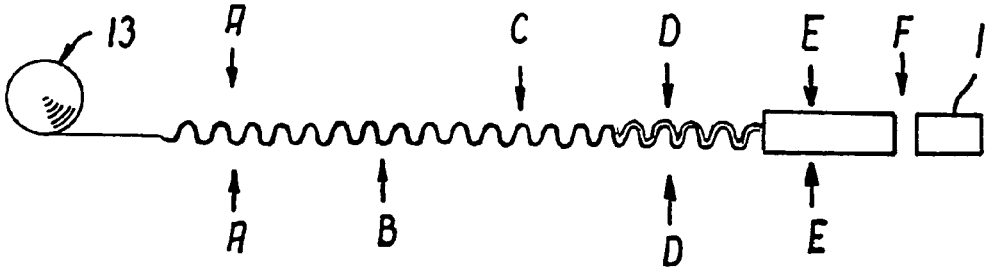
FIG. 6 is a diagrammatic presentation of a method of manufacturing the structural member according to the invention.

Manufacture of the structural member 1 may be carried out as shown diagrammatically in FIG. 6, in which the sheet or foil material is unwound from a coil 13 and subjected to a rolling operation at. A to provide a length of material which is corrugated in a continuous waveform. The exact shape, pitch and height of the corrugations may be varied. Subsequently, the corrugations are partly cut in the area of the first joining line 4 at B by means of a cutting tool and an abutment in the shape of an endless belt of an elastic material, and the groove along the second joining line 5 is formed at C by means of a pair of rollers (not shown) which press against the length of material which also in this position is supported by an endless elastic belt. By a number of guides (not shown), which may be in the form of a number of rollers or rails, at D and E, the corrugated metal sheet or foil is folded and the corrugations of each first section 3*a* are positioned between the corrugations of the base portion 2. At F the now U-shaped metal sheet or foil may be cut into appropriate lengths to form a number of structural members 1 according to the invention, typical values of the length of the members being in the range of 500 to 3000 mm. In case the first and second sections of each leg portion 3 are to be adhesively connected with each other, a double-sided self-adhesive tape is placed on the first or second section before the rolling operation at A or, alternatively, a suitable adhesive is applied on the wave crests of the first and/or second section following this rolling operation.

In addition to or as an alternative to imparting rigidity or increased stability to eg. a hollow structure, such a member may have other purposes. For instance, a plurality of structural members according to the invention may be used as an alternative to honeycomb or other sandwich-shaped structures for heating purposes by allowing a heated fluid to flow through the passages provided by the members. Moreover, the hollow space defined between the structural member and an underlying surface or in the interspace between two joined structural members as shown in FIG. 5 may be used for eg. wiring.

It is furthermore noted that the term "at substantially right angles", as used in connection with the position of the leg portions with respect to the base portion, as well as the statement "substantially 90°" in connection with the final folding step should be interpreted as comprising a suitable interval.

The invention should not be regarded as being limited to the embodiments described in the above but various modifications and combinations of the shown embodiments may be carried out without departing from the scope of the following claims.

The invention claimed is:

1. A structural member (1) having a generally U-shaped cross-section, an inner side and an outer side and a longitudinally extending configuration, comprising a base portion (2) and two leg portions (3) extending at substantially right angles from said base portion, said structural member comprising at least one corrugated portion and each leg portion (3) including a first section (3*a*) forming an inner wall of the leg portion and a second section (3*b*) parallel with said first section and joining the first section along a first joining line (4) and the base portion along a second joining line (5) characterized in that said structural member is formed as a unit from at least one thin sheet or foil which is corrugated in a continuous waveform in the longitudinal direction of the member; and that the corrugations on the outer side of the structural member are partly cut along the first joining line (4) that form gaps (11) , the first section and the second section being connected with each other at longitudinal edges of the gaps.

2. A structural member as claimed in claim 1, characterized in that the corrugations of each first section (3*a*) are interlocked with the corrugations of the base portion (2) in the area of said second joining line.

3. A structural member as claimed in claim 1, characterized in that a groove is formed in the area of said second joining line (5) on the inner side of the structural member (1).

4. A structural member as claimed in claim 1, characterized in that the structural member comprises at least one foil or sheet of metal or plastic material or a combination thereof.

5. A structural member as claimed in claim 4, characterized in that the structural member comprises at least one foil or sheet of aluminum or an aluminum alloy.

6. A structural member as claimed in claim 1, characterized in that said at least one sheet or foil has a thickness lying in the range of 0.01–0.5 mm.

7. A structural member as claimed in claim 1, characterized in that the first and second sections (3*a*, 3*b*) of the leg portion are adhesively connected to each other.

8. A method of manufacturing a structural member as claimed in claim 1, comprising the steps of folding a first section of at least one length of a corrugated sheet or foil material corresponding to said first section of the leg portion along said first joining line substantially 180 to abut a second section of said at least one length of material corresponding to said second section of the leg portion, and folding said first and second sections along said second joining line substantially 90, the corrugations on a second side of said at least one length of material corresponding to the outer side of said structural member being partly cut in the area of the first joining line prior to said first folding step.

9. A method as claimed in claim 8, characterized in that during said final folding step the corrugations of said first section of the leg portion are positioned in interlocking relationship with the corrugations of the base portion in the area of the second joining line.

10. A method as claimed in claim 8, characterized in that prior to said first folding step a groove is formed on a first side of said at least one length of material corresponding to the inner side of said structural member in the area of said second joining line.

11. A method as claimed in claim 8, characterized in that said corrugated material is formed by corrugating at least one plane sheet or foil in a continuous waveform.

12. A method as claimed in claim 8, characterized in that prior to said final folding step, the first and second sections are adhesively connected with each other.

13. A method as claimed in claim 8, characterized in that following said positioning step, the at least one corrugated and folded length of material is cut into appropriate lengths to form a number of structural members.

14. A structural member as claimed in claim 2, characterized in that a groove is formed in the area of said second joining line (5) on the inner side of the structural member (1).

15. A structural member as claimed in claim 14, characterized in that the structural member comprises at least one foil or sheet of metal or plastic material or a combination thereof.

16. A structural member as claimed in claim 15, characterized in that the structural member comprises at least one foil or sheet of aluminum or an aluminum alloy.

17. A structural member as claimed in claim 16, characterized in that said at least one sheet or foil has a thickness lying in the range of 0.01–0.5 mm.

18. A structural member as claimed in claim 17, characterized in that the first and second sections (3*a*, 3*b*) of the leg portion are adhesively connected to each other.

19. A method as claimed in claim 9, characterized in that prior to said first folding step a groove is formed on a first side of said at least one length of material corresponding to the inner side of said structural member in the area of said second joining line.

20. A method as claimed in claim 19, characterized in that said corrugated material is formed by corrugating at least one plane sheet or foil in a continuous waveform.

* * * * *